United States Patent [19]
Lu
[11] 4,147,645
[45] Apr. 3, 1979

[54] ELECTROGRAPHIC FLASH FUSING TONERS

[75] Inventor: Chin H. Lu, Webster, N.Y.
[73] Assignee: Xerox Corporation, Stamford, Conn.

[21] Appl. No.: 864,053
[22] Filed: Dec. 23, 1977
[51] Int. Cl.[2] ..... G03G 9/08
[52] U.S. Cl. ..... 252/62.1 P; 96/1 SD; 96/5; 252/404; 260/45.95 R; 260/45.95 C; 260/45.95 D
[58] Field of Search ..... 96/1 SD; 252/62.1, 404; 260/45.95

[56] References Cited

U.S. PATENT DOCUMENTS 3,060,020 10/1962 Greig ..... 252/62.1 P
3,493,638 2/1970 Meltsner ..... 260/45.95 D
3,933,665 1/1976 Van Engeland ..... 252/62.1 P

*Primary Examiner*—John D. Welsh
*Attorney, Agent, or Firm*—J. J. Ralabate; A. A. Mahassel; E. O. Palazzo

[57] ABSTRACT

There is described an electrophotographic toner comprising a resin material and as an additive a sterically hindered phenol, that is a phenol that has its atoms arranged in a particular manner in a molecule and does not undergo an expected chemical reaction due to inhibition by particular atomic groupings. These phenols are effective as thermal stabilizers for toner resins in that they reduce the rate of thermal decomposition and/or act as plasticizers in that they lower the toner melt viscosities and fusing temperatures.

18 Claims, No Drawings

ELECTROGRAPHIC FLASH FUSING TONERS

BACKGROUND OF THE INVENTION

This invention relates generally to flash fusing and more specifically to improved toner compositions for use in flash fusing electrographic imaging processes.

In the electrophotographic process and more specifically the xerographic process, a plate generally comprising a conductive backing upon which is placed a photoconductive insulating surface is uniformly charged and subsequently the photoconductive surface is exposed to a light image of the original to be reproduced. The photoconductive surface is made in such a manner so as to cause it to become conductive under the influence of the light image in order that the electrostatic charge found thereon can be selectively dissipated to produce what is developed by means of a variety of pigmented resin materials specifically made for this purpose, such as toners. The toner material used is electrostatically attracted to the latent image areas on the plate in proportion to the charge concentration contained thereon. For example, areas of high charge of concentration become areas of high toner density and correspondingly low charge images become proportionately less dense. Subsequently, the developed image is transferred to a final support material such as paper and fixed thereto for a permanent record or copy of the original.

Many methods are known for applying the electroscopic particles to the electrostatic latent image to be developed such as for example the development method described in E. N. Wise U.S. Pat. No. 2,618,552, "Cascade Development." Another method of developing electrostatic latent images is in the magnetic brush process as disclosed for example in U.S. Pat. Nos. 2,874,063; 3,251,706; and 3,357,402. In this method a developer material containing toner and magnetic carrier particles is carried by a magnet with the magnetic field of the magnet causing alignment of the magnetic carrier into a brush like configuration. The magnetic brush is brought in close proximity of the electrostatic latent image bearing surface and the toner particles are drawn from the brush to the electrostatic latent image by electrostatic attraction. Other methods of development include for example powder cloud development as described in C. F. Carlson U.S. Pat. No. 2,221,776, touchdown development as described in R. W. Gundlach U.S. Pat. No. 3,166,432 and cascade development as described in U.S. Pat. No. 3,099,943.

Fixing of the image can be accomplished in a number of various techniques including for example those that are more commonly used such as vapor fixing, heat fixing, pressure fixing, or combinations thereof as described for example in U.S. Pat. No. 3,539,161. These techniques of fixing do suffer from some deficiencies which render their use either impractical or difficult for specific electrostatographic applications. For example, it has been found rather difficult to construct an entirely satisfactory heat fuser which has short warm up time, high efficiency and ease of control. Another problem generally associated with heat fusers is that they burn or scorch the support material, for example, paper. Similar problems exist with pressure fixing methods whether used with heat or without heat and more particularly such problems include for example image offsetting, resolution degradation, and further there cannot be consistently produced a good permanent type of fix.

Vapor fixing has many advantages but it has one overriding problem in that a toxic solvent has to be used which in most cases make it commercially inoperable because of the health hazards and pollution control standards involved. For example, equipment and apparatus to sufficiently isolate the fuser from the surrounding air must be by its very nature very complex, costly, difficult to operate, and difficult to contain consistent results.

Modern electrostatographic reproducing apparatus resulted in the development of new materials and new processing techniques, one main development being the production of an automatic electrostatographic reproducing apparatus which is capable of producing copies at extremely rapid rates. It has been found that the best method for fixing in such types of machine is radiant flash fusing. One of the main advantages of the flash fuser over other known methods is that the energy which is emitted in the form of electromagnetic waves is instantly available and requires no intervening medium for its propagation. However, although an extremely rapid transfer of energy between the source and the receiving body is provided when using the flash fusing process, one major problem encountered with such a system is designing an apparatus which can fully and efficiently utilize a preponderance of the radiant energy emitted by the source during a relatively short flash period. The toner image usually comprises a relatively small percentage of the total area of the copy receiving the radiant energy and because of the properties of most copying materials, as for example, paper, most of the energy thereon is wasted by being transmitted through the copy or being reflected away from the fusing area.

Additionally, when radiant energy from a flash fuser is generated at levels necessary to fuse the toner, objectional odor and smoke results in some instances because of the thermal decomposition of the base resin at the temperature at which fusing must occur.

SUMMARY OF THE INVENTION

It is therefore an object of this invention to provide toners which overcome the above noted disadvantages.

It is a further object of this invention to provide toners useful in a flash fusing environment.

Also another object of the present invention is to provide toner materials which are effective in reducing the rate of thermal decomposition of the base resins.

Still another object is the production of toners which lowers the toner melt viscosity and the fusing temperature.

It is yet another object to produce a toner which has a dual function that is it reduces the rate of thermal decomposition of the base resin and at the same time lowers the toner melt viscosities, and fusing temperatures.

These and other objects of the present invention are accomplished by providing an electrophotographic toner comprising a resin material and as an additive a sterically hindered phenol, that is a phenol that has its atoms arranged in a particular manner in a molecule and does not undergo an expected chemical reaction due to inhibition by particular atomic groupings. These phenols are effective as thermal stabilizers for toner resins in that they reduce the rate of thermal decomposition. In one embodiment, the sterically hindered phenols function in a dual capacity, that is they not only reduce the rate of thermal decomposition of the base resin used in the toner, but at the same time act as plasticizers in that they lower the toner melt viscosities and fusing temperatures.

The sterically hindered phenols used are of the following formula:

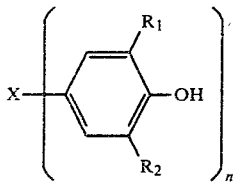

wherein $R_1$ and $R_2$ are radicals independently selected from the group consisting of aliphatic radicals generally containing from 1 to about 20 carbon atoms, preferably from 1 to about 8 carbon atoms, however, any aliphatic group that does not adversely effect the properties of the resulting material can be used; and X can be any grouping that will result in an additive of the desired properties, such as those groupings selected from the group consisting of hydrocarbons including aliphatic alkanes, alkenes, alkynes, aromatic, carboxylic, ester and phosphonate, phosphate, sulfate, sulfonate, nitrate and the like, and n is a number from 1 to about 4.

Illustrative examples of aliphatic radicals include methyl, ethyl, propyl, isopropyl, butyl, isobutyl, pentyl, hexyl, octyl, nonyl, decyl, pentadecyl, and eicosyl. Examples of alkenes and alkynes include those containing from 1 to about 10 carbon atoms including ethylene, propylene, butylene, pentene, decene ethyne, propyne, pentyne, and hexyne.

Examples of aromatic radicals include those containing from about 6 to about 14 carbon atoms and preferably from about 6 to 10 carbon atoms including phenyl, naphthyl, anthnacene, substituted phenyls, naphthyls, and anthracene, the substituents being aliphatic, hydroxyl, halo, nitro, amino, sulfonyl, amino groups, and the like.

Illustrative examples of materials used include sterically hindered phenols of the above formula with molecular weights of not less than 500, some preferred materials being tetrakis[methylene 3-(3',5'-di-t-butyl-4'-hydroxy phenyl)propionate]methane, o,o-di-n-octadecyl-3,5-di-tert-butyl-4 -hydroxy benzyl phosphonate, and octadecyl 3-(3',5'-di-tert-butyl-4'-hydroxyl phenyl)-propionate.

Generally, the sterically hindered phenols are present in amounts that will accomplish the above objectives and not adversely affect the imaging systems. For example, such amounts would range from about 0.1 to about 50 and more specifically from about 0.5 to about 20 percent based on the weight of the toner. In order to achieve optimum results it is preferred that the sterically hindered phenol be present in amount 0.5 to 10 percent based on the weight of the toner.

Any suitable resin material may be used for the toner compositions of the present invention. Substantially transparent resins are preferred when the toner is to be used in a color electrophotographic system. Although any substantially transparent resin material may be utilized as the resin component of this toner, it is preferable that resins having other desirable properties be utilized in this invention. Thus, for example, it is desirable that a resin be used which is a non-tacky solid at room temperature so as to facilitate handling and use in the most common electrophotographic processes. Thermal plastics are desirable with melting points significantly above room temperature, but below that of which ordinary paper tends to char so that once the toner images form thereon or transfer to a paper copy sheet it may be fused in place by subjecting it to heat. The resins selected should desirably have good triboelectric properties and have sufficient insulating properties to hold charge so that they may be employed in a number of development systems.

While any suitable resin possessing the properties as above described may be employed in the system of the present invention, particularly good results are obtained with the use of vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene; p-chlorostyrene; vinyl naphthalene; ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbazole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric stability and uniform resistance against physical degradation. However, non-vinyl type thermoplastic resins may also be employed including resin modified phenol formaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the present invention. The diphenol reactant has the general formula:

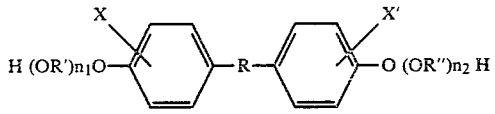

wherein R can be substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' are substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R is an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl)propane, 2,2-bis(4-beta hydroxy ethoxy phenyl)pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl)propane, 1,1-bis(4-hydroxy-ethoxy-phenyl)-butane, 1,1-bis(4-hydroxy isopropoxy-phenyl)-heptane, 2,2-bis(3-methyl-4-beta-hydroxy ethoxy-phenyl)propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)nor-bornane, 2,2-bis(4-beta hydroxy styryl oxyphenyl)propane, the polyoxyethyelen ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol disclosed herein to form the toner compositions of this invention either substituted or unsubstituted, saturated or unsaturated, having the general formula:

$$HOOC\ R'''\ n_3\ COOH$$

wherein R''' is a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re. 25,136 to Carlson and polystyrene blends as described in U.S. Pat. No. 2,788,288 to Rheinfrank and Jones.

Where carrier materials are employed with the toner compositions of the present invention in cascade and magnetic brush development, the carrier particles employed may be electrically conductive, insulating, magnetic or non-magnetic, as long as the carrier particles are capable of triboelectrically obtaining a charge of opposite polarity to that of the toner particles so that the toner particles adhere to and surround the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include: sodium chloride, ammonium chloride, aluminum potassium chloride, Rochelle salt, sodium nitrate, aluminum nitrate, potassium chlorate, granular zircon, granular silicon, methyl methacrylate, glass, steel, nickel, iron, ferrites, ferromagnetic materials, silicon dioxide and the like. The carriers may be employed with or without a coating. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to methyl terpolymer coated carriers which are the reaction products of organo silanes, silanols or siloxanes with unsaturated polymerizable organic compounds (optimum among those disclosed are terpolymer coatings achieved with a terpolymer formed from the addition polymerization reaction between monomers or prepolymers of: styrene, methylmethacrylate and unsaturated organo silanes, silanols or siloxanes); and nickel berry carriers as disclosed in U.S. Pat. Nos. 3,847,604 and 3,767,598. Nickel berry carriers are modular carrier beads of nickel characterized by a surface of recurring recesses and protrusions giving the particles a relatively large external surface area. An ultimate coated carrier particle diameter between about 50 microns to about 1000 microns is preferred because the carrier particles then possess sufficient density and inertia to avoid adherence to the electrostatic images during the cascade development process. The carrier may be employed with the toner composition in any suitable combination, generally satisfactory results have been obtained when about 1 part toner is used with about 10 to about 200 parts by weight of carrier.

The toners of the present invention also may be utilized in systems such as powder cloud development which do not require any carrier.

Any suitable pigment or dye may be employed as the colorant for the toner particles. Toner colorants are well known and include, for example, carbon black, nigrosine dye, aniline blue, Calco Oil Blue, chrome yellow, ultramarine blue, Du Pont Oil Red, Quinoline Yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional xerographic copies of typed documents are desired, the toner may comprise a black pigment such as carbon black or a black dye such as Amaplast Black dye, available from the National Aniline Products, Inc. Preferably, the pigment is employed in an amount from about 3 percent to about 20 percent by weight, based on the total weight of the colored toner. If the toner colorant employed is a dye, substantially smaller quantities of colorant may be used.

The toner compositions of the present invention may be prepared by any well known toner mixing and commination technique. For example, the ingredients may be thoroughly mixed by blending, mixing and milling the components and thereafter micropulverizing the resulting mixture. Another well known technique for forming toner particles is to spray-dry a ball-milled toner composition comprising a colorant, a resin and a solvent.

The toner compositions of the present invention may be used to develop electrostatic latent images on any suitable electrostatic surface capable of retaining charge including conventional photoconductors. The photoconductive layer may comprise an inorganic or an organic photoconductive material. Typical inorganic materials include: sulfur, selenium, zinc sulfide, zinc oxide, zinc cadmium sulfide, zinc magnesium oxide, cadmium selenide, zinc silicate, calcium strontium sulfide, cadmium sulfide, 4-dimethylaminobenzylidene benzhydrazide; 3-benzylidene- amino-carbazole, polyvinyl carbazole; (2-nitro-benzylidene)-p-bromo-aniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinyl-carbazole-trinitrofluorenone charge transfer complex; phthalocyanines and mixtures thereof.

The flash fusing system for use in the fusing process utilizing the toner of the present invention may be any of the known flash fusers such as disclosed in U.S. Pat. Nos. 3,529,129; 3,903,394; and 3,474,223. A flash fuser generally utilizes a Xenon flash lamp. The output of the lamp is primarily in the visible and near infrared wavelengths. The output of the flash lamp is measured by joules using the capacitor bank energy in accordance with the formula $\frac{1}{2} CV^2$ wherein C is capacitance and V is voltage. One of the main advantages of the flash fuser over other known methods of fusing is that the energy propagated in the form of electromagnetic waves is immediately available and no intervening source is needed for its propagation. Also flash fusing systems do not require long warm up periods, and the energy does not have to be transferred through a relatively slow conductive or corrective heat transfer mechanism.

The following examples are being supplied to further define the specifics of the present invention, it being noted that these examples are intended to illustrate and not limit the scope of the invention. Parts and percentages are by weight unless otherwise indicated.

EXAMPLE I

As a control there was prepared a toner resin by melt mixing followed by attrition using a Banberry apparatus and jetting, comprised of 90 parts of 65/35 styrene-n-butyl methacrylate copolymer and 10 parts of carbon black with no additive being present. This was subjected to flash fusing temperatures of 250° C. with the result that degradation occurred, the rate of thermal degradation, percent weight loss per hour was 6.75, thereby resulting in images of low resolution and causing objectionable odor and smoke to be produced. The weight loss number obtained, (6.75) was arrived at by determining the difference in weight prior to fusing and subsequent to flash fusing. In this Example the weight loss was 6.75 percent per hour, which is rather high and thus undesirable.

EXAMPLE II

The process as described in Example 1 was repeated with the exception that sterically hindered phenols were employed. The following tables indicate the results obtained, under the conditions recited.

| I. Toner | Percent Additive | Temperature ° C. | Rate of Thermal Degradation |
|---|---|---|---|
| 90 parts of 65/35 styrene-n-butyl methacrylate copolymer and 10 parts of carbon black | 0.5% of tetrakis [methylene 3-(3' 5'-di-t-butyl-4'-hydroxy phenyl) propionate] methane | 250 | Percent weight loss 0.49 per hour |

| II. Toner | Percent Additive | Temperature ° C. | Rate of Thermal Degradation |
|---|---|---|---|
| 90 parts of 65/35 styrene-n-butyl methacrylate copolymer and 10 parts of carbon black | 3% of tetrakis [methylene 3-3', 5' di-t-butyl-4'-hydroxy phenyl) propionate] methane | 250 | Percent weight loss per hour 0.46 (desirable) |
| 90 parts of 65/35 styrene-n-butyl methacrylate copolymer and 10 parts of carbon black | 0 | 275 | 24 (undesirable) |
| 90 parts of 65/35 styrene-n-butyl methacrylate copolymer and 10 parts of carbon black | 3% of tetrakis [methylene 3-3', 5' di-t-butyl-4'-hydroxy phenyl) propionate] methane | 275 | 1.75 |

| III. Toner | Percent Additive | Temperature ° C. | Rate of Thermal Degradation |
|---|---|---|---|
| 90 parts of 65/35 styrene-n-butyl methacrylate copolymer and 10 parts of carbon black | 0 | 250 | 6.75 |
| 90 parts of 65/35 styrene-n-butyl methacrylate copolymer and 10 parts of carbon black | 3% of O,O-di-n-octadecyl-3,5-di-tert-butyl-4 hydroxy benzyl phosphonate | 250 | 0.69 |

EXAMPLE III

The procedure of Example II was repeated using as the resin 80/20 styrene/isobutyl methacrylate, with additive and without additive. Similar results were obtained, that is smoking and an odor was observed when no additive was present, however, no smoking or odor were observed when the additive was used.

| Percent Additive | Temp. ° C. | Rate of Thermal Degradation |
|---|---|---|
| 0 | 250 | 7.42 |
| 3% tetrakis [methylene 3-3', 4' di-t-butyl-4'-hydroxy phenyl) propionate] methane | 250 | 0.74 |

EXAMPLE IV

The procedure of Examples II and III were repeated using in addition to the toner and additive, a 250 micron steel shot carrier coated with styrene methyl methacrylate copolymers. An electrostatic latent image is developed with this material, resulting in a toner image that corresponds to the latent image. The powder image is then transferred to paper, and permanently affixed thereto by flash fusing. Similar results are observed when no additive is present, that is images of low resolution resulted, and objectionable smoking and odor are detected as compared with images of high resolution and no smoking or odor being detected when an additive is present.

EXAMPLE V

The procedure of Example IV is repeated, however both the toner with additive and the toner without additive were flash fused at about 200° C. It is observed that the toner with additive had a better fix as compared to the toner without additive as determined by Taber Abration testing using a brush and by measuring the optical density subsequent to flash fusing, of the toner with additive and without additive. The toner with additive is of a higher optical density, indicating a better fix, than the toner without additive.

Other modifications of the present invention will occur to those skilled in the art upon reading of the present disclosure. These are intended to be included within the scope of this invention.

What is claimed is:

1. A toner composition for use in flash fusing electrophotographic imaging systems comprised of a resin and an additive of a sterically hindered phenol of the formula:

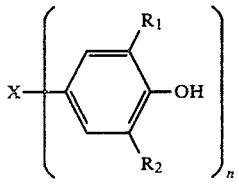

wherein $R_1$ and $R_2$ are independently selected from the group consisting of aliphatic radicals, X is selected from the group consisting of hydrocarbons, carboxylic ester and phosphonate, phosphate, sulfate, sulfonate and nitrate radicals, and n is a number from 1 to about 4.

2. A toner in accordance with claim 1 wherein the aliphatic radical contains 1 to about 20 carbon atoms, and the hydrocarbon radical contains from 6 to about 14 carbon atoms.

3. A toner in accordance with claim 1 wherein the aliphatic radical is methyl and the hydrocarbon radical is phenyl.

4. A toner in accordance with claim 1 wherein the additive is O,O-di-n-ocatdecyl-3,5-di-tert-butyl-4-hydroxy benzyl phosphonate.

5. A toner in accordance with claim 1 wherein the additive is tetrakis[methylene 3-(3',5'-di-t-butyl-4'-hydroxy phenyl)propionate]methane.

6. A toner in accordance with claim 1 wherein the resin is styrene-n-butyl methacrylate.

7. A toner in accordance with claim 1 wherein the amount of additive present is between about 0.5 percent and 20 percent based on the weight of toner.

8. A toner in accordance with claim 1 wherein a carrier material is added to the composition.

9. A toner in accordance with claim 8 wherein the carrier material is steel that is coated with a styrene methyl methacrylate copolymer.

10. A toner in accordance with claim 8 wherein the additive is tetrakis[methylene 3-(3',5'-di-t-butyl-4' hydroxy phenyl)propionate]methane.

11. A method of imaging comprising forming an electrostatic latent image contacting the image with a toner comprising an additive of a sterically hindered phenol of the formula:

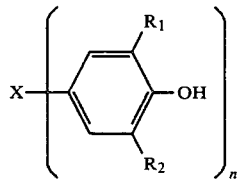

wherein $R_1$ and $R_2$ are independently selected from the group consisting of aliphatic radicals, X is selected from the group consisting of hydrocarbons, carboxylic ester and phosphonate, phosphate, sulfate, sulfonate and nitrate radicals and n is a number from 1 to about 4 and subsequently transferring the image to a substrate, followed by fixing said image using a flash fusing device.

12. A method in accordance with claim 11 wherein the aliphatic radical contains 1 to about 20 carbon atoms, and the hydrocarbon radical contains from 6 to about 14 carbon atoms.

13. A method in accordance with claim 11 wherein the aliphatic radical is methyl and the hydrocarbon radical is phenyl.

14. A method in accordance with claim 11 wherein the additive is O,O-di-n-ocatdecyl-3,5-di-tert-butyl-4 hydroxy benzyl phosphonate.

15. A method in accordance with claim 11 wherein the additive is tetrakis[methylene 3-(3',5'-di-t-butyl-4'-hydroxy phenyl)propionate]methane.

16. A method in accordance with claim 11 wherein the resin is styrene-n-butyl methacrylate.

17. A method in accordance with claim 11 wherein the amount of additive present is between about 0.5 percent and 20 percent based on the weight of toner.

18. A method in accordance with claim 11 wherein the sterically hindered phenol reduces the rate of thermal decomposition of the toner resin and lowers the toner melt viscosity and fusing temperature of the toner.

* * * * *